US010695652B1

(12) United States Patent
Shute et al.

(10) Patent No.: US 10,695,652 B1
(45) Date of Patent: Jun. 30, 2020

(54) MAGNETICALLY ATTACHABLE SLIDING APPARATUS AND SYSTEMS

(71) Applicant: G3 GENUINE GUIDE GEAR INC., Burnaby, B.C. (CA)

(72) Inventors: Cameron Shute, Nelson (CA); Michael Coletti, Vancouver (CA)

(73) Assignee: G3 Genuine Guide Gear Inc., Burnaby, BC (CA)

( * ) Notice: Subject to any disclaimer, the term of this patent is extended or adjusted under 35 U.S.C. 154(b) by 0 days.

(21) Appl. No.: 16/361,148

(22) Filed: Mar. 21, 2019

(51) Int. Cl.
*A63C 5/06* (2006.01)
*A63C 5/02* (2006.01)

(52) U.S. Cl.
CPC . *A63C 5/06* (2013.01); *A63C 5/02* (2013.01)

(58) Field of Classification Search
CPC ..... A63C 5/06
See application file for complete search history.

(56) References Cited

U.S. PATENT DOCUMENTS

| | | | | |
|---|---|---|---|---|
| 3,260,531 A | | 7/1966 | Heuvel | |
| 3,479,044 A | * | 11/1969 | Peis | A63C 11/022 280/601 |
| 4,199,169 A | | 4/1980 | Guenzel et al. | |
| 4,377,297 A | | 3/1983 | Staufer | |
| 4,898,401 A | | 2/1990 | Champagnac | |
| 5,203,583 A | | 4/1993 | LeGrand et al. | |
| 5,803,479 A | | 9/1998 | Meyer et al. | |
| 5,871,225 A | | 2/1999 | Sutherland | |
| 7,540,525 B2 | | 6/2009 | Ametsbichler et al. | |
| 7,823,892 B2 | | 11/2010 | Olson et al. | |
| 8,172,250 B2 | | 5/2012 | Krafft et al. | |
| 8,251,395 B2 | | 8/2012 | Ellison | |
| 8,511,704 B2 | | 8/2013 | Olson et al. | |
| 9,020,782 B2 | | 4/2015 | Czaja et al. | |
| 9,821,214 B2 | | 11/2017 | Browning | |
| 2006/0091645 A1 | | 5/2006 | Cobb et al. | |

(Continued)

FOREIGN PATENT DOCUMENTS

| | | |
|---|---|---|
| AT | 552036 T | 4/2012 |
| DE | 2013174 A1 | 10/1971 |
| DE | 2502031 A1 | 7/1976 |

(Continued)

OTHER PUBLICATIONS

"How can you shield a magnet?" http://www.coolmagnetman.com/magshield.htm retrieved Mar. 21, 2019 (8 pages).

*Primary Examiner* — John D Walters
*Assistant Examiner* — James J Triggs
(74) *Attorney, Agent, or Firm* — Kolisch Hartwell, P.C.

(57) ABSTRACT

One aspect of this disclosure is a sliding apparatus. In some aspects, the sliding apparatus may comprise an elongated body containing magnets. The elongated body may comprise a toe end, a tail end, a top surface, and a slide surface. In one aspect, the magnets may be located between the toe and tail ends of the elongated body, spaced apart from one another in the elongated body, and polarized to define top poles oriented toward the top surface of the elongated body and bottom poles oriented toward the slide surface of the elongated body. For example, the magnets may be arranged so the bottom poles have alternating polarities in a direction relative to the elongated body. Related apparatus and systems also are disclosed.

20 Claims, 11 Drawing Sheets

(56) References Cited

U.S. PATENT DOCUMENTS

| | | | |
|---|---|---|---|
| 2007/0114779 | A1 | 5/2007 | Ametsbichler et al. |
| 2016/0339326 | A1 | 11/2016 | Postaire |

FOREIGN PATENT DOCUMENTS

| | | | |
|---|---|---|---|
| DE | 202006003785 | U1 | 6/2006 |
| DE | 102006034227 | A1 | 5/2007 |
| DE | 102006034227 | B4 | 6/2009 |
| DE | 102015006121 | A1 | 11/2016 |
| EP | 1787692 | A2 | 5/2007 |
| EP | 1787692 | A3 | 12/2008 |
| EP | 1787692 | B1 | 4/2012 |
| FR | 2483241 | A1 | 12/1981 |
| FR | 2341330 | A1 | 9/1997 |
| JP | H07204309 | A | 8/1995 |
| JP | H08112392 | A | 5/1996 |
| KR | 101810628 | B1 | 12/2017 |
| WO | 2012104457 | A1 | 8/2012 |

* cited by examiner

MAGNETICALLY ATTACHABLE SLIDING APPARATUS AND SYSTEMS

BACKGROUND

1. Field

Aspects of the present disclosure generally relate to sliding apparatus and systems comprising magnetically attachable features.

2. Description of Related Art

Sliding apparatus for winter sports—such as snow skis, snowboards, and the like—may be configured for alpine touring. For example, most pairs of snow skis have toe bindings engageable with toe portions of footwear (e.g., a ski boot), and heel bindings engageable with heel portions of the footwear. When configured for alpine touring, the heel bindings may be operable in a downhill mode, in which the heel portion is attached to the ski for sliding downhill; and a touring mode, in which the heel portion is released from the ski to allow for easier walking and/or climbing uphill. Even with this additional functionality, it may still be necessary to detach the footwear from the bindings when touring, such as when the terrain becomes too steep or too rocky for traversal with the heel bindings in the touring mode.

Traversing steep and/or rocky terrain with detached snow skis presents its own challenges, such as carrying the skis. One solution for hands-free climbing is to interlock the ski brakes together and attach the interlocked skis to a backpack with straps. But this is not always possible. For example, many alpine touring skis forgo ski brakes to minimize weight; and interlocking the ski brakes (if present) still may not prevent the ends of the skis from splaying apart while climbing. To provide a further example, climbing skins are commonly attached to alpine touring skis to assist with uphill navigation, and it also may not be possible to interlock the ski brakes when the skins are attached to the skis.

Sliding apparatus for summer sports—such as water skis, wakeboards, and surf boards—may present similar challenges. For example, many of these apparatus may be equally difficult to carry, store, and transport due to their size and shape.

SUMMARY

Numerous aspects are described in this disclosure. One aspect is a sliding apparatus. For example, the sliding apparatus may comprise: an elongated body comprising a toe end, a tail end, a top surface, and a slide surface; and at least three magnets that are (i) located between the toe and tail ends, (ii) spaced apart from one another in the elongated body, (iii) polarized to define top poles oriented toward the top surface and bottom poles oriented toward the slide surface, and (iv) arranged so the bottom poles have alternating polarities in a direction relative to the elongated body.

Each magnet of the at least three magnets may comprise a rare earth metal. The at least three magnets may be located proximate to the toe end; and the apparatus may comprise at least three additional magnets that are (i) located proximate to the tail end, (ii) spaced apart from one another in the elongated body, (iii) polarized to define top poles oriented toward the top surface and bottom poles oriented toward the slide surface, and (iv) arranged so the bottom poles have alternating polarities in a direction relative to the elongated body. In some aspects, the alternating polarities of the at least three magnets may be opposite of the alternating polarities of the at least three additional magnets.

A polarity indicator of each magnet of the at least three magnets for which the top pole has a first polarity may be different from a polarity indicator of each magnet of the at least three magnets for which the top pole has a second polarity opposite the first polarity. The direction may extend laterally across the elongated body. Each magnet of the at least three magnets may have a width; and the at least three magnets may be spaced apart from another by a distance that is equal to or less than the width. A distance between the top surface of the elongated body and the at least three magnets may be approximately equal to or greater than a distance between the slide surface of the elongated body and the at least three magnets.

The sliding apparatus may comprise a second sliding apparatus. For example, the second sliding apparatus may comprise: an elongated body comprising a toe end, a tail end, a top surface, and a slide surface; and at least three magnets that are (i) located between the toe and tail ends, (ii) spaced apart from one another in the elongated body, (iii) polarized to define top poles oriented toward the top surface and bottom poles oriented toward the slide surface, and (iv) arranged so the bottom poles have alternating polarities in a direction relative to the elongated body, wherein the alternating polarities of the bottom poles of the at least three magnets of the sliding apparatus are opposite of the alternating polarities of the bottom poles of the at least three magnets of the second sliding apparatus.

As a further example, the at least three magnets of the sliding apparatus may be located proximate to the toe end of the sliding apparatus; the at least three magnets of the second sliding apparatus may be located proximate to the toe end of the second sliding apparatus; the sliding apparatus may further comprise at least three additional magnets that are (i) located proximate to the tail end, (ii) spaced apart from one another in the elongated body, (iii) polarized to define top poles oriented toward the top surface and bottom poles oriented toward the slide surface, and (iv) arranged so the bottom poles have alternating polarities in a direction relative to the elongated body; the second sliding apparatus may further comprise at least three additional magnets that are (i) located proximate to the tail end, (ii) spaced apart from one another in the elongated body, (iii) polarized to define top poles oriented toward the top surface and bottom poles oriented toward the slide surface, and (iv) arranged so the bottom poles have alternating polarities in a direction relative to the elongated body; and the alternating polarities of the bottom poles of the at least three additional three magnets of the sliding apparatus may be opposite of the alternating polarities of the bottom poles of the at least three additional magnets of the second sliding apparatus.

As a further example, the alternating polarities of the bottom poles of the at least three magnets located proximate to the toe end of the sliding apparatus may be opposite the alternating polarities of the bottom poles of the at least three additional magnets located proximate to the tail end of the sliding apparatus; and the alternating polarities of the bottom poles of the at least three magnets located proximate to the toe end of the second sliding apparatus may be opposite the alternating polarities of the bottom poles of the at least three additional magnets located proximate to the tail end of the second sliding apparatus.

Another aspect is a sliding apparatus. For example, the sliding apparatus may comprise: an elongated body comprising a toe end, a tail end, a top surface, and a slide surface;

and a plurality of magnets that are (i) located between the toe and tail ends, (ii) spaced apart from one another in the elongated body, (iii) offset from the slide surface, (iv) polarized to define top poles oriented toward the top surface and bottom poles oriented toward the slide surface, and (v) comprise a pull force equal to at least a weight of the elongated body.

The top surface of the elongated body may be engageable with a binding and the pull force of the plurality of magnets may be equal at least the weight of the elongated body and a weight of the binding. The slide surface of the elongated body may be engageable with a climbing skin and the pull force of the plurality of magnets may be equal at least the weight of the elongated body, the weight of the binding, and a weight of the climbing skin. Additional weights may be similarly accommodated. In some aspects, the plurality of magnets may be arranged so the bottom poles have alternating polarities in a direction relative to the elongated body.

The sliding apparatus may comprise a second sliding apparatus. For example, the second sliding apparatus may comprise: an elongated body comprising a toe end, a tail end, a top surface, and a slide surface; and a plurality of magnets that are (i) located between the toe and tail ends, (ii) spaced apart from one another in the elongated body, (iii) offset from the slide surface, (iv) polarized to define top poles oriented toward the top surface and bottom poles oriented toward the slide surface, and (v) comprise a pull force equal to at least a weight of the elongated body.

The sliding apparatus also may comprise an object, such as an accessory or a mount. For example, the sliding apparatus may comprise an object that is removably attachable to the elongated body by a magnetic interaction with one or more magnets of the plurality of magnets. As a further example, the object may comprise one of: a camera; a light source; a memory; a mounting portion; a power source; a processor; a sensor; and a storage bay.

Another aspect is a sliding apparatus. For example, the sliding apparatus may comprise: an elongated body comprising a toe end, a tail end, a top surface, a slide surface, and a reinforcing material adjacent the slide surface; and at least one set of magnets that are (i) located between the toe and tail ends, (ii) spaced apart from one another in the elongated body, (iii) offset from the slide surface, (iv) adjacent the reinforcing material, and (v) polarized to define top poles oriented toward the top surface and bottom poles oriented toward the slide surface.

In some aspects, the slide surface may comprise a polymeric material and the reinforcing material may be attached to the polymeric material. A magnetic shielding layer may be located between the top surface of the elongated body and the at least one set of magnets. In some aspects, the at least one set of magnets may be arranged in a curved direction extending across the body.

Aspects of numerous additional apparatus and systems also are described, along with aspects of various kits and methods related thereto.

BRIEF DESCRIPTION OF THE DRAWINGS

The accompanying drawings, which are incorporated in and constitute part of this disclosure, illustrate exemplary aspects that, together with the written descriptions, serve to explain the principles of this disclosure. Numerous aspects are particularly described, pointed out, and taught in the written descriptions. Some structural and operational aspects may be even better understood by referencing the written portions together with the accompanying drawings, of which.

DETAILED DESCRIPTION

Figure 1:
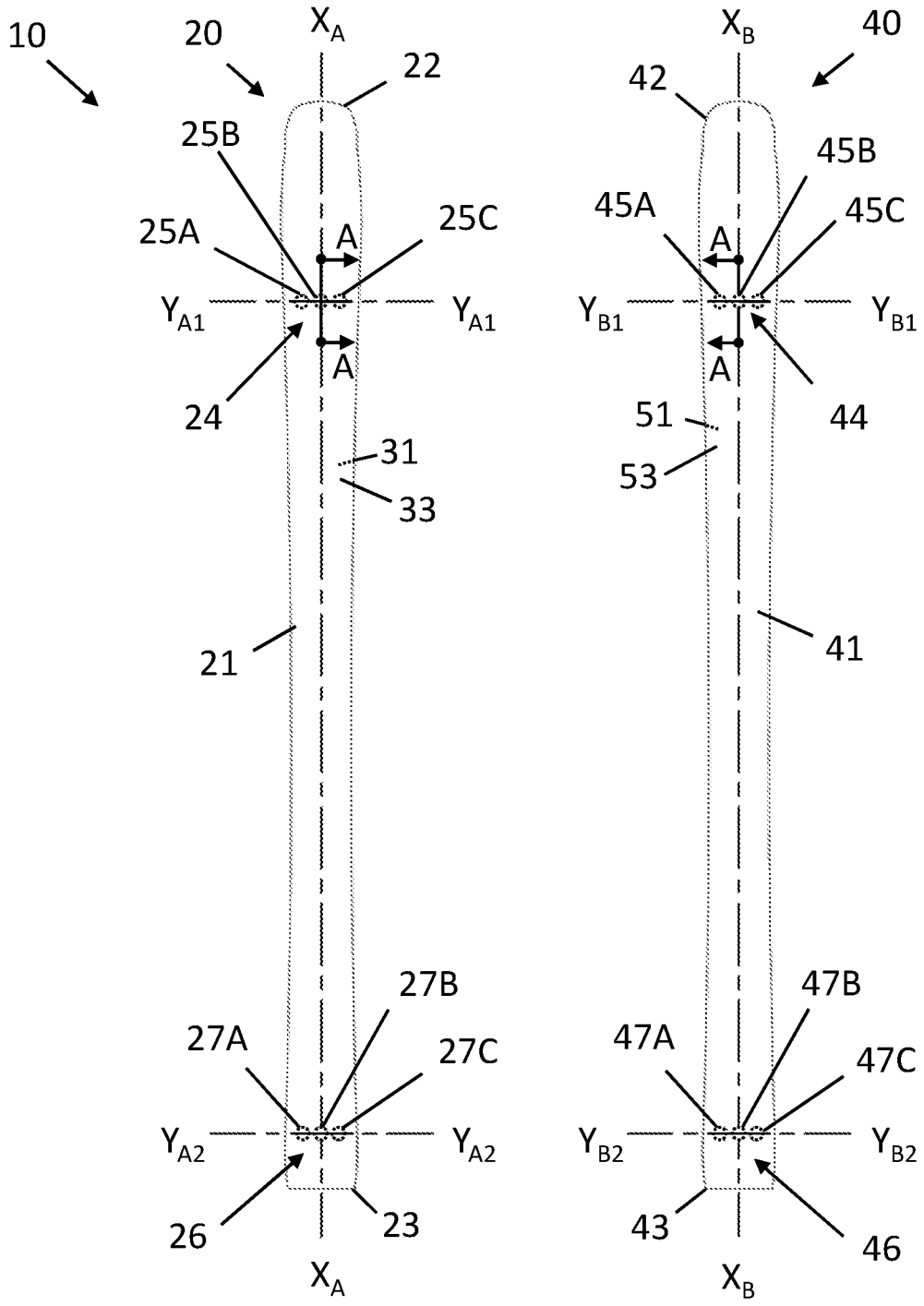
FIG. 1 depicts bottom views of an exemplary first sliding apparatus and an exemplary second sliding apparatus and indicates section line A-A.

Aspects of the present disclosure are not limited to the exemplary structural details and component arrangements described in this description and shown in the accompanying drawings. Many aspects of this disclosure may be applicable to other aspects and/or capable of being practiced or carried out in various variants of use, including the examples described herein.

Throughout the written descriptions, specific details are set forth in order to provide a more thorough understanding to persons of ordinary skill in the art. For convenience and ease of description, some well-known elements may be described conceptually to avoid unnecessarily obscuring the focus of this disclosure. In this regard, the written descriptions and accompanying drawings should be interpreted as illustrative rather than restrictive, enabling rather than limiting.

Exemplary aspects of this disclosure reference sliding apparatus and systems for use in winter and/or summer sports. Some aspects are described with reference to particular attachment elements (e.g., rare earth magnets) operable to removably attach particular sliding apparatus (e.g., snow skis or halves of a split snowboard) to one another and/or other objects (e.g., a roof or wall). Unless claimed, these exemplary aspects are provided for convenience and not intended to limit the present disclosure. Accordingly, the concepts described in this disclosure may utilize any attachment means and with any type of apparatus.

Several different axes are described, including: one or more longitudinal X-X axis, one or more lateral Y-Y axis, and one or more depth axis Z-Z. Various aspects may be described with reference to these different axes. Each longitudinal axis X-X, lateral axis Y-Y, and/or depth axis Z-Z may define relative arrangements. For example, each longitudinal axis X-X may be non-parallel with at least one lateral axis Y-Y and at least one depth axis Z-Z in some perspectives, meaning that axes Y-Y and/or Z-Z may extend across and/or intersect axis X-X. The term "elongated" may describe any aspect having a length along one of axes X-X, Y-Y, and/or Z-Z that is longer in relation to a width along a non-parallel one of axes X-X, Y-Y, and/or Z-Z. Additional axes, movements, and forces also may be described with reference to axes X-X, Y-Y, and/or Z-Z. These relative terms are provided for convenience and do not limit this disclosure unless claimed.

As used herein, inclusive terms such as "comprises," "comprising," "includes," "including," and variations thereof, are intended to cover a non-exclusive inclusion, such that an apparatus, system, or element thereof comprising a list of elements does not include only those elements, but may include other elements not expressly listed and/or inherent thereto. Unless stated otherwise, the term "exemplary" is used in the sense of "example," rather than "ideal." Various terms of approximation may be used in this disclosure, including "approximately" and "generally." Unless stated otherwise, approximately means within 10% of a stated number or outcome and generally means "within most cases" or "usually."

Figure 2:
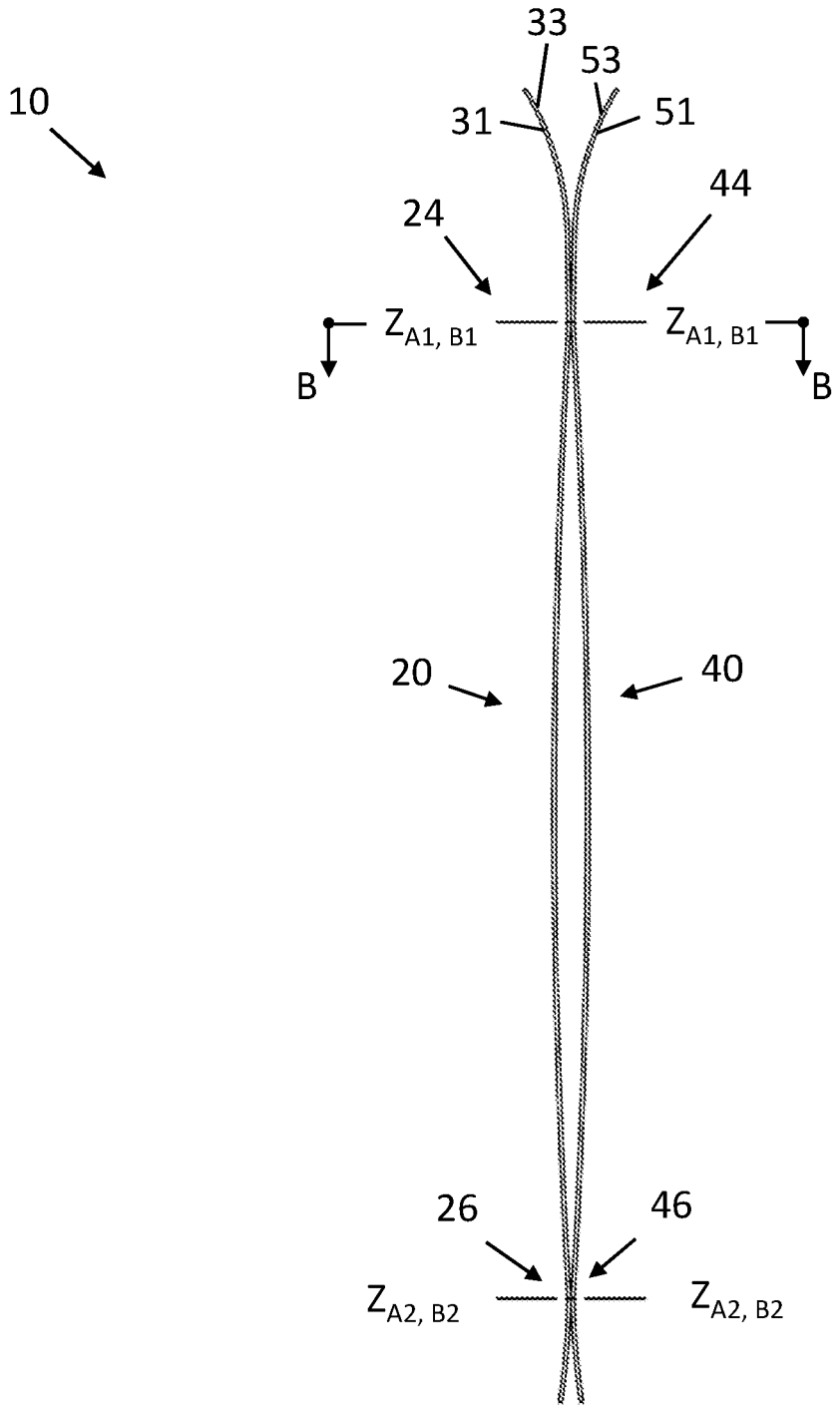
FIG. 2 depicts a side view of the first and second sliding apparatus of FIG. 1, and indicates section line B-B.

Aspects are now described with reference to FIG. 1, which shows an exemplary system 10 comprising a first sliding apparatus 20 and a second sliding apparatus 40, shown as snow skis in this example. A bottom view of sliding apparatus 20 and 40 is shown in FIG. 1. Although depicted as snow skis, each sliding apparatus 20 and 40 may be any type of sliding apparatus used generally for winter sports, such as one half of a split snowboard, a snowshoe, a sled, or the like; or any type of sliding apparatus used generally for summer sports, such as a water ski, a wake board, a surf board, or the like. As shown in FIG. 2, one or more portions of first sliding apparatus 20 may be removably attached to one or more portions of second sliding apparatus 40, which may allow sliding apparatus 20 and 40 to be transported together without additional attachment elements, such as interlocking snow brakes and/or straps. In some aspects, sliding apparatus 20 may comprise a plurality of magnets, sliding apparatus 40 may comprise a plurality of magnets, the portion(s) of sliding apparatus 20 may be removably attached to the portion(s) of sliding apparatus 40 using a magnetic interaction between the pluralities of magnets, and the magnetic interaction may maintain apparatus 20 against apparatus 40 during transport and/or correct for any transport-related impact forces.

As shown in FIG. 1, for example, first sliding apparatus 20 may comprise an elongated body 21 extending along a longitudinal axis $X_A$-$X_A$ between a toe end 22 and a tail end 23. Elongated body 21 may comprise at least one coupler, such as a toe coupler 24 proximate to toe end 22 and/or a tail coupler 26 proximate to tail end 23. The at least one coupler may comprise a plurality of magnets. For example, toe coupler 24 and tail coupler 26 may comprise any number of magnets. As a further example, shown in FIG. 1, toe coupler 24 may comprise a set of magnets comprising least three magnets, including a magnet 25B on longitudinal axis $X_A$-$X_A$, a magnet 25A on one side of axis $X_A$-$X_A$, and a magnet 25C on the other side of axis $X_A$-$X_A$; and tail coupler 26 may comprise a set of magnets comprising at least three magnets, including a magnet 27B on longitudinal axis $X_A$-$X_A$, a magnet 27A on one side of axis $X_A$-$X_A$, and a magnet 27C on the other side of axis $X_A$-$X_A$.

Magnets 25A-C of toe coupler 24 and magnets 27A-C of tail coupler 26 may be contained in elongated body 21 and/or spaced apart in one or more directions relative to axis $X_A$-$X_A$. As shown in FIG. 1, magnets 25A-C may be spaced apart from one another in a toe portion of elongated body 21; and magnets 27A-C may be spaced apart from another in a tail portion of body 21. For example, magnets 25A-C may be spaced apart laterally along a first lateral axis $Y_{A1}$-$Y_{A1}$; and magnets 27A-C may be spaced apart laterally along a second lateral axis $Y_{A2}$-$Y_{A2}$. Each lateral axis $Y_{A1}$-$Y_{A1}$ and $Y_{A2}$-$Y_{A2}$ may be non-parallel and/or generally perpendicular with longitudinal axis $X_A$-$X_A$. The orientation of lateral axes $Y_{A1}$-$Y_{A1}$ and $Y_{A2}$-$Y_{A2}$ relative to longitudinal axis $X_A$-$X_A$ may be the same or different. For example, an angle of lateral axis $Y_{A1}$-$Y_{A1}$ relative to longitudinal axis $X_A$-$X_A$ may be different from an angle of lateral axis $Y_{A2}$-$Y_{A2}$ relative to axis $X_A$-$X_A$. Each lateral axes $Y_{A1}$-$Y_{A1}$ and $Y_{A2}$-$Y_{A2}$ also may be curved relative to longitudinal axis $X_A$-$X_A$. For example, each axis $Y_{A1}$-$Y_{A1}$ and $Y_{A2}$-$Y_{A2}$ may be curved relative to a point between couplers 24 and 26 to accommodate a likely movement path between apparatus 20 and 40.

Aspects of second sliding apparatus 40 may be similar to aspects of first sliding apparatus 20. As shown in FIG. 1, for example, first sliding apparatus 20 may be configured for use with a right foot and second sliding apparatus 40 may be configured for use with a left foot, making apparatus 20 and 40 a functional pair.

As also shown in FIG. 1, for example, second sliding apparatus 40 may similarly comprise an elongated body 41 extending along a longitudinal axis $X_B$-$X_B$ between a toe end 42 and a tail end 43. Elongated body 41 may comprise at least one corresponding coupler, engageable with the at least one coupler of sliding apparatus 20, such as a corresponding toe coupler 44 proximate to toe end 42 and a corresponding tail coupler 46 proximate to tail end 43. The at least one corresponding coupler may comprise a plurality of magnets. For example, toe coupler 44 and tail coupler 46 also may comprise any number of magnets. As a further example, shown in FIG. 1, toe coupler 44 may comprise a set of magnets comprising at least three magnets, including a magnet 45B on longitudinal axis $X_B$-$X_B$, a magnet 45A on one side of longitudinal axis $X_B$-$X_B$, and a magnet 45C on the other side of axis $X_B$-$X_B$; and tail coupler 46 may comprise a set of magnets comprising at least three magnets, including a magnet 47B on longitudinal axis $X_B$-$X_B$, a magnet 47A on one side of longitudinal axis $X_B$-$X_B$, and a magnet 47C on the other side of axis $X_B$-$X_B$.

The magnets of toe and tail couplers 44 and 46 (e.g., magnets 45A-C and 47A-C of FIG. 1) may correspond with the magnets of toe and tail couplers 24 and 26 (e.g., magnets 25A-C and 27A-C of FIG. 1). For example, positions of magnets 25A-C on sliding apparatus 20 of FIG. 1 may be a precise or approximate mirror image of positions of magnets 45A-C on sliding apparatus 40 of FIG. 1; and positions of magnets 27A-C on apparatus 20 may be a precise or approximate mirror image of positions magnets 47A-C on apparatus 40. As a further example, positions of magnets 25A-C relative to each other and positions of magnets 45A-C relative to each other may be similar, identical, or different from positions of magnets 27A-C and positions of magnets 47A-C relative to each other.

Magnets 45A-C of toe coupler 44 and magnets 47A-C of tail coupler 46 also may contained in elongated body 41 and/or spaced apart in one or more directions relative to axis $X_B$-$X_B$. As shown in FIG. 1, magnets 45A-C may be spaced apart from one another in a toe portion of elongated body 41; and magnets 47A-C may be spaced apart from another in a tail portion of body 41. For example, magnets 45A-C may be spaced apart laterally along a first lateral axis $Y_{B1}$-$Y_{B1}$; and magnets 47A-C may be spaced apart laterally along a second lateral axis $Y_{B2}$-$Y_{B2}$. Each lateral axis $Y_{B1}$-$Y_{B1}$ and $Y_{B2}$-$Y_{B2}$ may be non-parallel and/or generally perpendicular with longitudinal axis $X_B$-$X_B$. For example, each axis $Y_{B1}$-$Y_{B1}$ and $Y_{B2}$-$Y_{B2}$ may be generally perpendicular with axis $X_B$-$X_B$, and the orientation of axes $Y_{B1}$-$Y_{B1}$ and $Y_{B2}$-$Y_{B2}$ relative to axis $X_B$-$X_B$ may be the same or different. As before, an angle of lateral axis $Y_{B1}$-$Y_{B1}$ with respect to axis $X_B$-$X_B$ may be different from an angle of lateral axis $Y_{B2}$-$Y_{B2}$ with respect to axis $X_B$-$X_B$. Each lateral axes $Y_{B1}$-$Y_{B1}$ and $Y_{B2}$-$Y_{B2}$ also may be curved relative to longitudinal axis $X_B$-$X_B$. For example, each axis $Y_{B1}$-$Y_{B1}$ and $Y_{B2}$-$Y_{B2}$ also may be curved relative to a point between couplers 44 and 46 to accommodate the likely movement path between apparatus 20 and 40.

Figure 3:
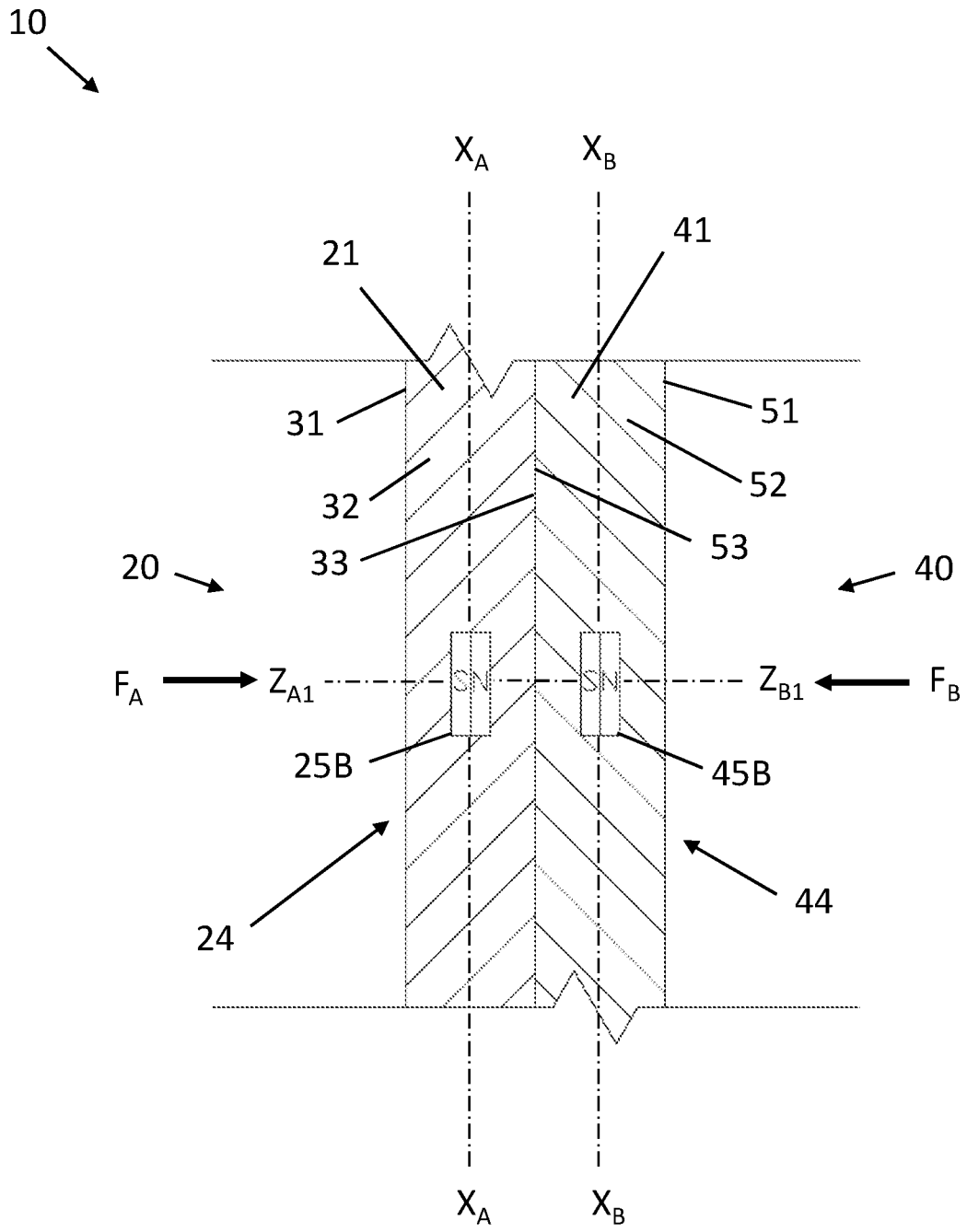
FIG. 3 depicts a cross-sectional view taken along section line A-A of FIG. 1.

Couplers 24, 26, 44, and 46 may be configured for high attachment strength. For example, any and/or all of magnets 25A-C, 27A-C, 45A-C, and 47A-C may comprise a rare earth metal and/or be neodymium magnets. To promote durability, magnets 25A-C, 27A-C, 45A-C, and 47A-C may be embedded and/or sealed within elongated body 21 or 41 to protect them from exposure to the elements. An example is shown in FIG. 3, in which elongated body 21 of first sliding apparatus 20 comprises a top surface 31, an interior portion 32, and a slide surface 33 arranged in layers along a first depth axis $Z_{A1}$-$Z_{A1}$; and elongated body 41 of second sliding apparatus 40 comprises a top surface 51, an interior portion 52, and a slide surface 53 arranged in layers along a second depth axis $Z_{B1}$-$Z_{B1}$. As a further example, magnets 25A-C (represented by magnet 25B) may be centered along first depth axis $Z_{A1}$-$Z_{A1}$ within interior portion 32 of elongated body 21; and magnets 45A-C (represented by magnet 45B) may be centered along second depth axis $Z_{B1}$-$Z_{B1}$ within interior portion 52 of elongated body 41. In other words, as shown in FIG. 3, a distance between top surface 31 and magnets 25A-C may be approximately equal to a distance between slide surface 33 and magnets 25A-C; and a distance between top surface 51 and magnets 45A-C may be approximately equal to a distance between slide surface 53 and magnets 45A-C.

Couplers 24 and 26 may be magnetically attracted to couplers 44 and 46. As shown in FIG. 3, for example, each magnet 25A-C and 45A-C may be polarized (e.g., along its respective depth axis $Z_{A1}$-$Z_{A1}$ or $Z_{B1}$-$Z_{B1}$) to define a top pole oriented toward top surface 31 or 51 and a bottom pole oriented toward slide surface 33 or 53. As a further example, a polarity of the bottom pole of each magnet 25A-C (represented by magnet 25B) may be opposite of a polarity of the bottom pole of each corresponding magnet 45A-C (represented by magnet 45B). Because of the opposite polarities, placing slide surface 33 of first sliding apparatus 20 opposite of slide surface 53 of second sliding apparatus 40 may cause magnets 25A-C to apply a first attraction force $F_A$ to elongated body 21 along first depth axis $Z_{A1}$-$Z_{A1}$ and magnets 45A-C to apply a second attraction force $F_B$ to elongated body 41 along second depth axis $Z_{B1}$-$Z_{B1}$. The resulting magnetic interactions between attraction forces $F_A$ and $F_B$ may be sufficient to maintain at least the toe portion of slide surface 33 against at least the toe portion of slide surface 53 during transport of first and second sliding apparatus 20 and 40.

Although not shown in FIG. 3, magnets 27A-C and 47A-C may be similar to any configuration of magnets 25A-C and 45A-C described herein. For example, magnets 27A-C and 47A-C may be similarly contained in elongated body 21 or 41; and similarly polarized and/or arranged. Accordingly, as shown in FIG. 2, the resulting magnetic interactions between tail and toe couplers 24, 44 (e.g., including magnets 25A-C, 45A-C) and tail and toe couplers 26, 46 (e.g., including magnets 27A-C, 47A-C) may be sufficient to maintain toe and tail portions of slide surface 33 against toe and tail portions of slide surface 53 during transport.

The attachment strengths of couplers 24, 26, 44, and 46 may vary. For example, magnets 25A-C, 27A-C, 45A-C, and 47A-C may comprise a magnetic field of 300 gauss or greater at a bottom face of magnets 25A-C, 27A-C, 45A-C, and 47A-C; and/or at slide surfaces 33, 53. The magnets of first sliding apparatus 20 may comprise a pull force equal to at least the weight of elongated body 21, and the magnets of second sliding apparatus 40 may comprise a pull force equal to at least the weight of elongated body 41. As shown in FIG. 1, for example, magnets 25A-C and 27A-C of apparatus 20 may comprise a pull force equal to at least a weight of elongated body 21; and magnets 45A-C and 47A-C of apparatus 40 may comprise a pull force equal to at least a weight of elongated body 41.

The magnets of couplers 24, 26, 44, and 46 may be offset from slide surface 33 or 53 and/or located in central portions 32 or 52 of body 21 or 41. An example is shown in FIG. 3, in which longitudinal axes $X_A$-$X_A$ and $X_B$-$X_B$ may be centrally located in elongated body 21 or 41, representative magnet 25B may be located on axis $X_A$-$X_A$, and representative magnet 45B may be located on axis $X_B$-$X_B$. As a further example, axes $X_A$-$X_A$ and $X_B$-$X_B$ may extend through a centroid of elongated body 21 or 41 in a cross-sectional plane defined by their respective X-X and Z-Z axes, and representative magnets 25B and 45B may be centered on and/or intersected by axis $X_A$-$X_A$ or $X_B$-$X_B$. As shown, a distance between top surfaces 31 or 51 and magnets 25B or 45B also may be approximately equal to a distance between slide surfaces 33 or 53 and magnets 25B or 45B.

Magnets 25A-C, 27A-C, 45A-C, and 47A-C may not be flush with or located immediately adjacent to slide surfaces 33 and 53. As shown in FIG. 2, for example, the magnetic interaction between magnets 25A-C and 45A-C adjacent toe ends 22 and 42 combined with the magnetic interaction between magnets 27A-C and 47A-C adjacent tail ends 23 and 43 may be sufficient to maintain slide surface 33 against slide surface 53 during transport even if magnets 25A-C, 27A-C, 45A-C, and 47A-C are offset from slide surfaces 33 or 53 and/or centrally located in elongated body 21 or 41 as shown in FIG. 3. Put another way, no matter where they are located in elongated body 21 or 41, the plurality of magnets of sliding apparatus 20 and 40 may comprise a pull force equal to at least a weight of elongated body 21 or 41.

As shown in FIG. 1, magnets 25A-C, 27A-C, 45A-C, and 47A-C may have non-alternating polarities in one or more directions relative to elongated body 21 or 41. For example, the polarity of each bottom pole of magnets 25A-C or 27A-C may be similar (e.g., N-N-N); and the polarity of each bottom pole of magnets 45A-C or 47A-C may be similar but opposite of the corresponding bottom poles of magnets 25A-C or 27A-C (e.g., S-S-S). As described further below, magnets 25A-C, 27A-C, 45A-C, and 47A-C also may have alternating polarities in the one or more directions relative to body 21 or 41.

Additional aspects are now described with reference to FIG. 4, which shows an exemplary system 110 comprising a first sliding apparatus 120 and a second sliding apparatus 140; and FIGS. 5 and 6, which show an exemplary system 210 comprising a first sliding apparatus 220 and a second sliding apparatus 240. Aspects of sliding apparatus 120, 140 and 220, 240 may be similar to counterpart aspects of sliding apparatus 20, 40, but within the respective 100 or 200 series of numbers, whether or not those aspects are expressly described or called out in FIGS. 4-6. Without limitation, any aspects described with reference to systems 110 and 210 may be applicable to any variation of system 10 described herein and vice versa, each possible iteration being part of this disclosure.

Figure 4:
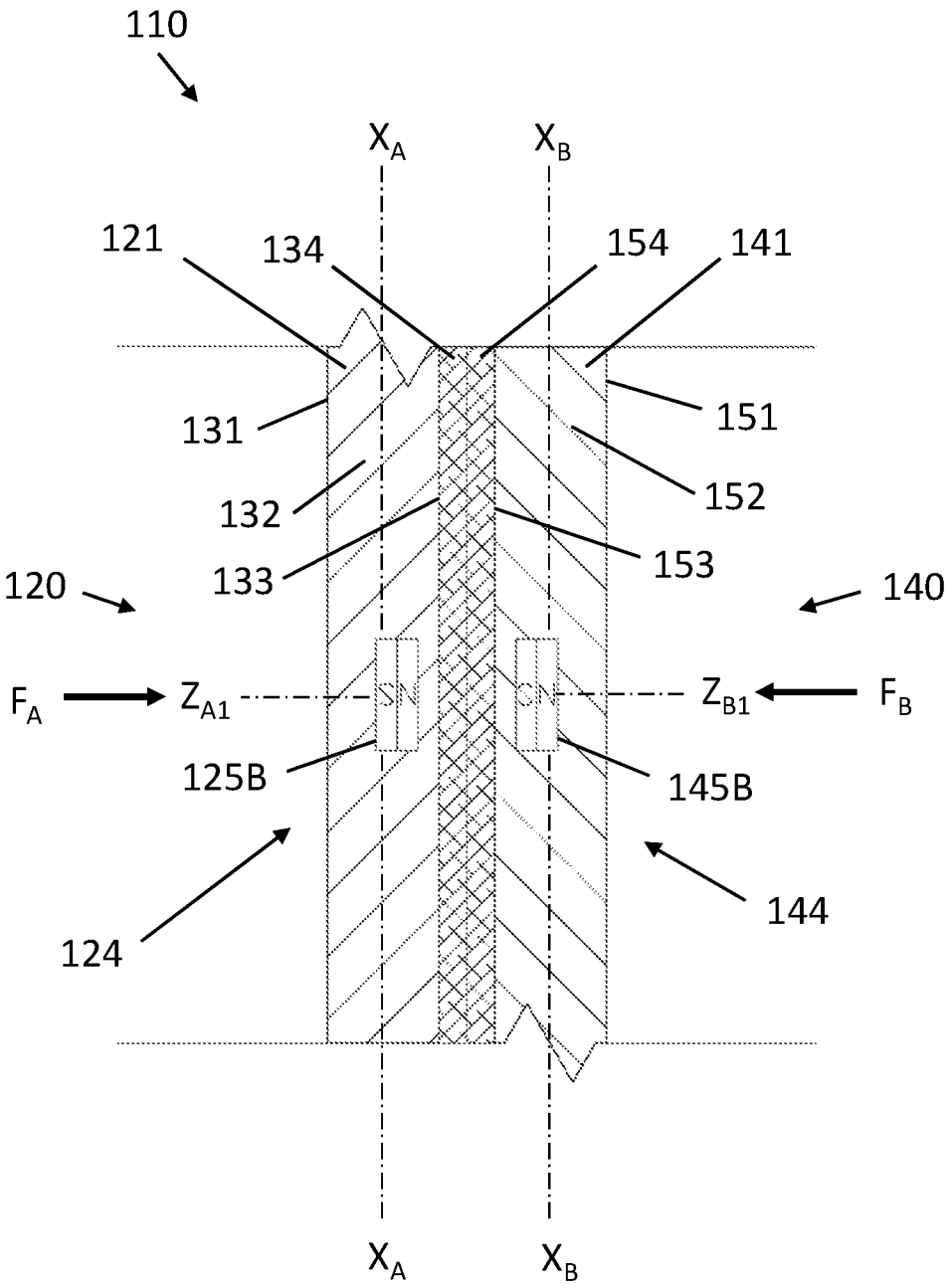
FIG. 4 depicts a cross-sectional view of another exemplary first sliding apparatus and another exemplary second sliding apparatus with climbing skins attached thereto.

As shown in FIG. 4, first and second sliding apparatus 120 and 140 of system 110 may be similar to first and second sliding apparatus 20 and 40 of system 10. For example, apparatus 120 may similarly comprise an elongated body 121 comprising a top surface 131, an interior portion 132, a slide surface 133, and at least one coupler 124; and apparatus 220 may similarly comprise an elongated body 141 comprising a top surface 151, an interior portion 152, a slide surface 153, and at least one coupler 144. Each coupler 124 may similarly comprise magnets positioned relative to a representative magnet 125B, like magnets 25A-C; and each coupler 144 may similarly comprise magnets positioned relative to a representative magnet 145B, like magnets 45A-C. Although not shown in FIG. 4, couplers 124, 144 may be located proximate to a toe end of bodies 121, 141 (e.g., similar to couplers 24, 44); and apparatus 120, 140 may comprise a second set of couplers proximate to a tail end of bodies 121, 141 (e.g., similar to couplers 26, 46). As before, the plurality of magnets of sliding apparatus 120 and 140 may comprise a pull force equal to at least a weight of elongated body 121 or 141.

As also shown in FIG. 4, a reusable adhesive may be used to attach a climbing skin 134 to slide surface 133 and a climbing skin 154 to slide surface 153. Similar to above, the magnetic strength of couplers 124 and 144 may be increased to accommodate climbing skins 134, 154 and the reusable adhesive. For example, even if they are centrally located as in FIG. 3 or offset from center as in FIG. 4, the magnetic strength of the magnets of coupler 124 (represented by magnet 125B of FIG. 4) and coupler 144 (represented by magnet 145B of FIG. 4) may be increased to maintain at least a toe portion of slide surfaces 133 and skin 134 against at least a toe portion of slide surface 153 and skin 154 during transport of apparatus 120 and 140 with climbing skins 134 and 154 attached thereto.

The magnets of couplers 124 and 144 also may be located closer to slide surfaces 133 and 153 to accommodate skins 134 and 154. An example is shown in FIG. 4, wherein longitudinal axes $X_A$-$X_A$ and $X_B$-$X_B$ may be centrally located in body 121 or 141, as before; the magnets of coupler 124 (represented by magnet 125B) may be offset from axis $X_A$-$X_A$ toward slide surface 133; and the magnets of coupler 144 (represented by magnet 145B) may be offset from axis $X_B$-$X_B$ toward slide surface 153. The magnets of couplers 124, 144 of FIG. 4 may be closer to slide surfaces 133, 153 than the magnets of couplers 24, 44 of FIG. 3. As shown in FIG. 4, for example, a distance between top surfaces 131, 151 and representative magnets 125B, 145B may be greater than a distance between slide surfaces 133, 153 and magnets 125B, 145B. Similar to above, a first attraction force $F_A$ may act upon elongated body 121 and slide surface 133 along first depth axis $Z_{A1}$-$Z_{A1}$, a second attraction force $F_B$ may act upon elongated body 141 and guide surface 153 along second depth axis $Z_{B1}$-$Z_{B1}$, and the resulting magnetic interaction between attraction forces $F_A$ and $F_B$ along axes $Z_{A1}$-$Z_{A1}$ and $Z_{B1}$-$Z_{B1}$ may maintain at least the toe portion of slide surface 133 and skin 134 against the toe portion of slide surface 153 and skin 154 when transporting apparatus 120 and 140 (e.g., similar to FIG. 2).

However they are configured, the magnets of each coupler 124 also may comprise a pull force equal to at least the weight of elongated body 121 and climbing skin 134; and the magnets of each coupler 144 may comprise a pull force equal to at least the weight of elongated body 141 and climbing skin 154. For example, using any arrangement, location, and/or number of magnets described herein, the magnets of couplers 124 and 144 may comprise a magnetic field equal to 300 gauss at bottom surfaces of the magnets, at slide surfaces 133, 153, and/or at surfaces of climbing skins 134, 154. As a further example, aspects of each at least one coupler 124 and 144 may be similarly modified to: accommodate additional weight(s) of additional object(s) attached to sliding apparatus 120 or 140, such as a binding attached to one or both of top surfaces 131 or 151; permit attachment of any objects described below with reference to FIGS. 11 and 12; and provide additional factors of safety (e.g., to accommodate for ice build-up).

Figure 5:
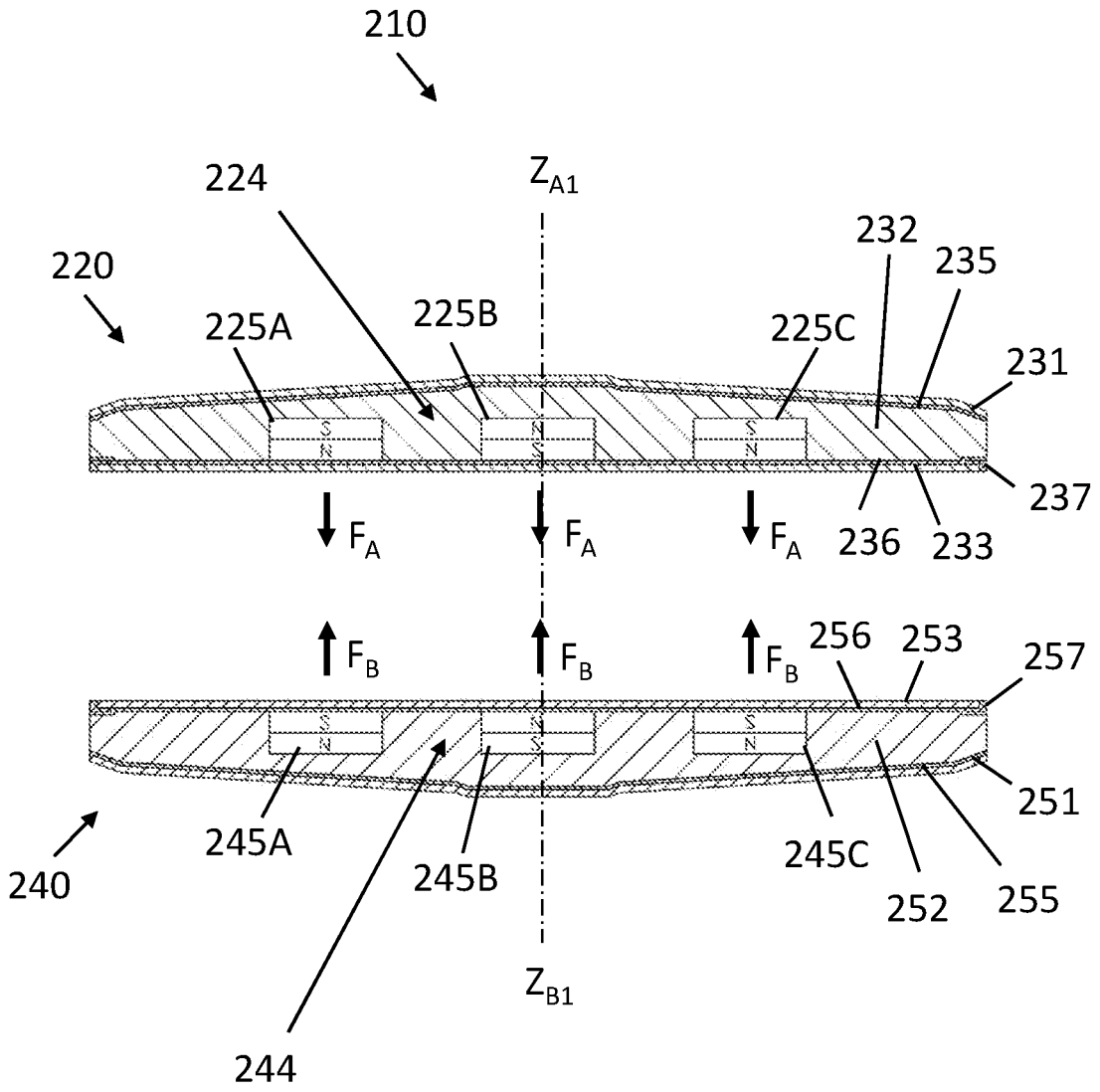
FIG. 5 depicts a cross-sectional view taken along section line B-B of FIG. 2, but with the first and second sliding apparatus spaced apart from one another.
Figure 6:
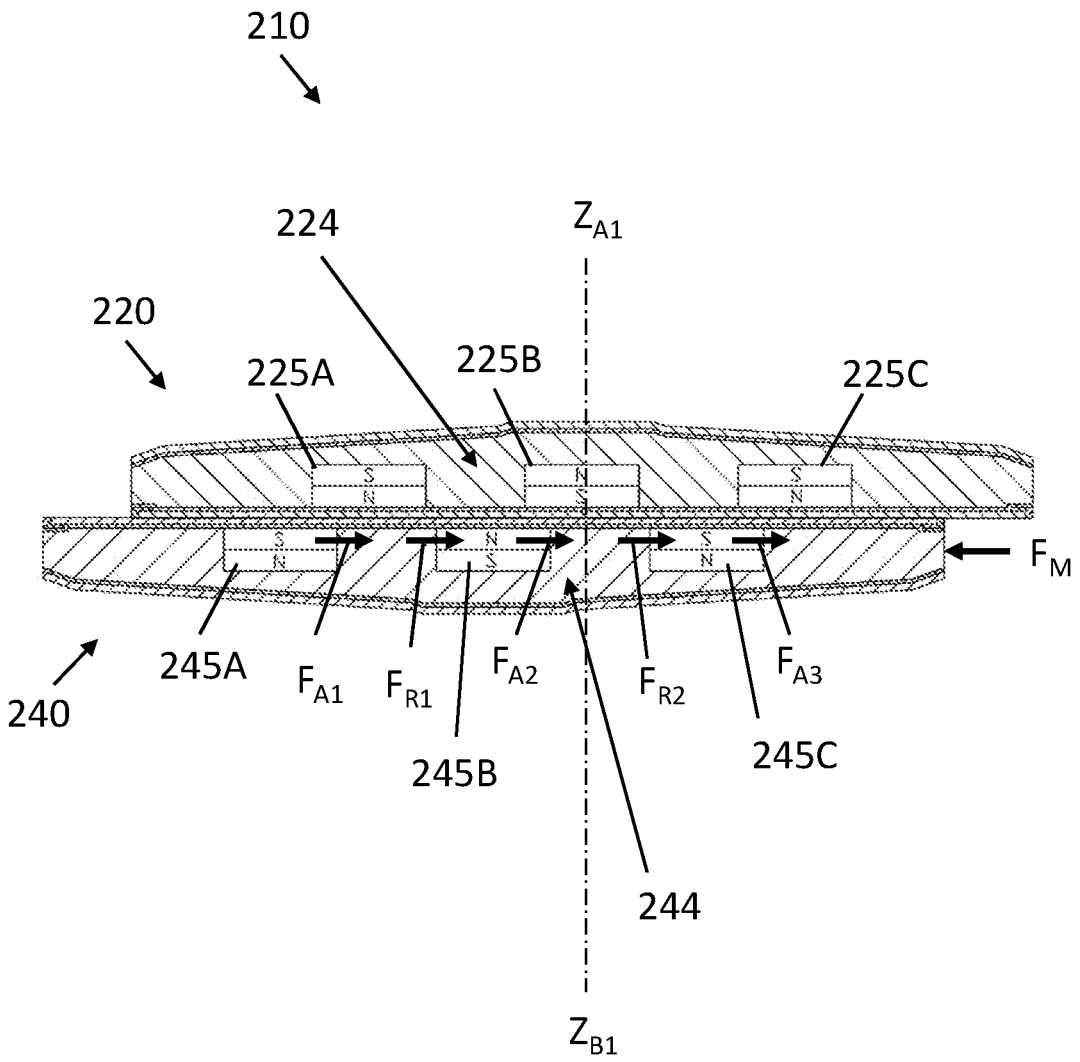
FIG. 6 depicts another cross-sectional view taken along section line B-B of FIG. 2, but with the first and second sliding apparatus splayed apart from one another.

As shown in FIGS. 5 and 6, first and second sliding apparatus 220 and 240 of system 210 may be similar to first and second sliding apparatus 20 and 40 of system 10. For example, first apparatus 220 may similarly comprise an elongated body 221 comprising a top surface 231, an interior portion 232, a slide surface 233, and at least one coupler 224; and second apparatus 220 may similarly comprise an elongated body 241 comprising a top surface 251, an interior portion 252, a slide surface 253, and at least one coupler 244. Each coupler 224 may similarly comprise a set of magnets, such as magnets 225A-C; and each coupler 244 may similarly comprise a corresponding set of magnets, such as magnets 245A-C. Although not shown in FIG. 4, couplers 224, 244 may be located proximate to a toe end of bodies 221, 241 (e.g., similar to couplers 24, 44); and apparatus 220, 240 may comprise a second set of couplers located proximate to a tail end of bodies 221, 241 (e.g., similar to couplers 26, 46). As before, the magnets of apparatus 220 and 240 may comprise a pull force equal to at least a weight of body 221 or 241.

Aspects of sliding apparatus 220 and 240 and the location of couplers 224 and 244 relative to those aspects may vary. An example is shown in FIG. 5, which depicts an exemplary cross-section of sliding apparatus 220 and 240 when spaced apart, prior to being removably attached together. As a further example, sliding apparatus 220 may comprise a reinforcing layer 235, a reinforcing layer 236, and edges 237; and sliding apparatus 240 may comprise a reinforcing layer 255, a reinforcing layer 256, and edges 257. As described herein, each reinforcing layer 235, 236, 255, and 256 may comprise any type of reinforcing material(s), including any combination of carbon fiber, fiber glass, metallic materials, polymeric materials, and the like. In some aspects, the materials of elongated bodies 221, 241 and slide surfaces 233, 253 may be comprised of materials different from the reinforcing material(s).

Reinforcing layers 235 and 236 may be arranged relative to interior portion 232 along depth axis $Z_{A1}$-$Z_{A1}$; and reinforcing layers 255 and 256 may be arranged relative to interior portion 252 along depth axis $Z_{B1}$-$Z_{B1}$. For example, reinforcing layer 236 may be located between slide surface 233 and magnets 225A-C; and at least a bottom surface of magnets 225A-C may be adjacent to (e.g., in contact with) layer 236. As a further example, reinforcing layer 235 may be located between top surface 231 and magnets 225A-C; and at least a top surface of magnets 225A-C may be adjacent to (e.g., in contact with) layer 235. Reinforcing layers 255 and 256 may be similarly configured.

As shown in FIG. 5, for example, magnets 225A-C may be in central portion 232 of elongated body 221 and configured to apply a first attraction force $F_A$ to reinforcing layer 236 when magnetically interacting with corresponding magnets or structures; and magnets 245A-C may be in central portion 252 of elongated body 241 and configured to apply a second attraction force $F_B$ to reinforcing layer 256 when magnetically interacting with corresponding magnets or structures. As a further example, a thickness of reinforcing layers 236 and 256 along depth axes $Z_{A1}$-$Z_{A1}$ and $Z_{B1}$-$Z_{B1}$ and/or a material composition of layers 236 and 256 may be configured to help distribute attraction forces $F_A$ and $F_B$ to slide surfaces 233 and 253. Reinforcing layers 235 and 255 also may be similar to or different from reinforcing layers 236 and 256. For example, reinforcing layers 236 and 256 may be thicker and/or otherwise more reinforced than reinforcing layers 235 and 255 to prevent magnets 225A-C and 245A-C from punching through with repeated use. As a further example, at least portions of layers 235, 236, 255, and/or 256 proximate to couplers 224 and 244 may be thickened or reinforced.

First and second sliding apparatus 220 and 240 may comprise magnetic shielding elements configured to prevent unwanted magnetic interactions in one or more directions. For example, apparatus 220 and 240 may comprise a metallic mesh or sheet that is located between top surfaces 231 and 251 and magnets 225A-C and 245A-C, and configured to hinder and/or prevent their magnetic fields from extending beyond top surfaces 231 and 251. As a further example, the metallic mesh or sheet may prevent unwanted magnetic interactions between magnets 225A-C and 245A-C and any metallic portions of any bindings attached to top surfaces 231 and/or 251. For example, the metallic mesh or sheet also may be engageable with screws to provide additional means for attaching the bindings.

Edges 237 and 257 may be composed of any material(s), including any combination of magnetic or non-magnetic materials. For example, at least portions of edges 237 and 257 proximate to couplers 224 and 244 along longitudinal axes $X_A$-$X_A$ and $X_B$-$X_B$ may be composed of non-magnetic materials (e.g., a rigid polymer, stainless steel, or the like) to minimize or prevent unwanted magnetic interactions with magnets 225A-C and 245A-C when removably attaching first sliding apparatus 220 to second sliding apparatus 240.

As shown in FIGS. 5 and 6, magnets 225A-C and 245A-C may be polarized (e.g., along their respective depth axes $Z_{A1}$-$Z_{A1}$ or $Z_{B1}$-$Z_{B1}$) to define top poles oriented toward top surface 231 or 251 and bottom poles oriented toward slide surface 233 or 253. As shown, magnets 225A-C and 245A-C may have alternating polarities in one or more directions relative to bodies 221 and 241. For example, the polarity of each bottom pole of magnets 225A-C may be different (e.g., N-S-N) and the polarity of each bottom pole of magnets 245A-C may be different and opposite of the corresponding bottom poles of magnets 225A-C (e.g., S-N-S). The alternating polarities and spacing of magnets 225A-C and 245A-C may provide performance benefits, and any magnets described herein may be similarly configured.

As shown in FIG. 6, for example, additional centering effects may be realized by magnetic shearing interactions between magnets 225B and 245B and magnets 225A, 245A and 225C, 245C; and the additional centering effects may help to maintain and/or restore an alignment between first sliding apparatus 220 and second sliding apparatus 240. For example, first sliding apparatus 220 may be held steady (e.g., as if attached to backpack), and second sliding apparatus 240 may be moved by a movement force $F_M$ (e.g., as if hit by a rock during transport when attached to the backpack). As shown in FIG. 6, movement force $F_M$ may be sufficient to move slide surface 253 of apparatus 240 in a lateral direction (e.g., left) relative to slide surface 233 of apparatus 220. The strength and central location of magnets 225B and 245B combined with the strength and spaced-apart locations of magnets 225A, 225C on each side of magnet 225B and magnets 245A, 245C on each side of magnet 245B may provide a combination of attractive and repulsive magnetic shear forces sufficient to counter movement force $F_M$ by causing slide surface 253 to move in an opposite lateral direction (e.g., right) relative to slide surface 233, at least partially restoring the pre-impact alignment between first and second sliding apparatus 220 and 240.

As shown in FIG. 6, for example, the attractive shear forces may comprise first attractive shear forces $F_A$ between magnets 225A and 245A, second attractive shear forces $F_{A2}$ between magnets 225B and 245B, and third attractive shear forces $F_{A3}$ between magnets 225C and 245C; and the repulsive shear forces may comprise first repulsive shear forces $F_{R1}$ between magnets 225A and 245B, and second repulsive shear forces $F_{R2}$ between magnet 225B and magnet 247C. As a further example, the central location of magnet 225B may allow it to interact with both magnets 245B and 245C, and the central location of magnet 245B may allow it to interact with both magnets 225A and 225B, providing the additional centering effects in response to even small movements of apparatus 240.

The strength of the additional centering effects may be proportionate to the spacing between magnets 225A-C and 245A-C because the strength of each magnet 225A-C and 245A-C may drop off in directions relative thereto. For example, each magnet 225A-C and 245A-C may have a width (e.g., a diameter), and magnets 225A-C and 245A-C may be spaced apart by a distance that is equal to or less than the width. Put another way, each magnet of magnets 225A-C and 245A-C of FIG. 5 may have a width in a lateral direction; and magnets 225A-C and 245A-C may be spaced apart from another in the lateral direction by a distance that is equal to or less than the width. The strength of the additional centering effects may not be realized if magnets 225A-C and 245A-C are spaced too far apart and/or if magnets 225B and 245B are omitted. As shown in FIG. 6, for example, the additional centering effects may not be realized without at least one magnet 225B and at least one magnet 245B because magnets 225A, 225C and 245A, 245C may otherwise be spaced too far apart (e.g., beyond one diameter apart and/or too close to the edges of bodies 221 and 421) and therefore only able to magnetically interact with one another so that additional centering forces $F_{R1}$, $F_{A2}$, and $F_{R2}$ cannot be realized.

If sliding apparatus 220 and 240 comprises a second set of couplers (e.g., similar to couplers 224, 244) comprising a second set of magnets (e.g., similar to magnets 225A-C, 245A-C), then the polarity arrangement of magnets 225A-C and 245A-C may similar or different to the polarity arrangement of the second sets of magnets so that apparatus 220 may only be attached to apparatus 240 in a particular way. For example, each second set of magnets may have alternating or non-alternating polarities configured so that a toe end of first apparatus 220 is magnetically attracted to a toe end of second apparatus 240 and magnetically repulsed by a tail end of second apparatus 240 and vice versa. Regardless of their polarities, the plurality of magnets of sliding apparatus 220 and 240 may comprise a pull force equal to at least a weight of elongated body 221 or 241.

Figure 7:
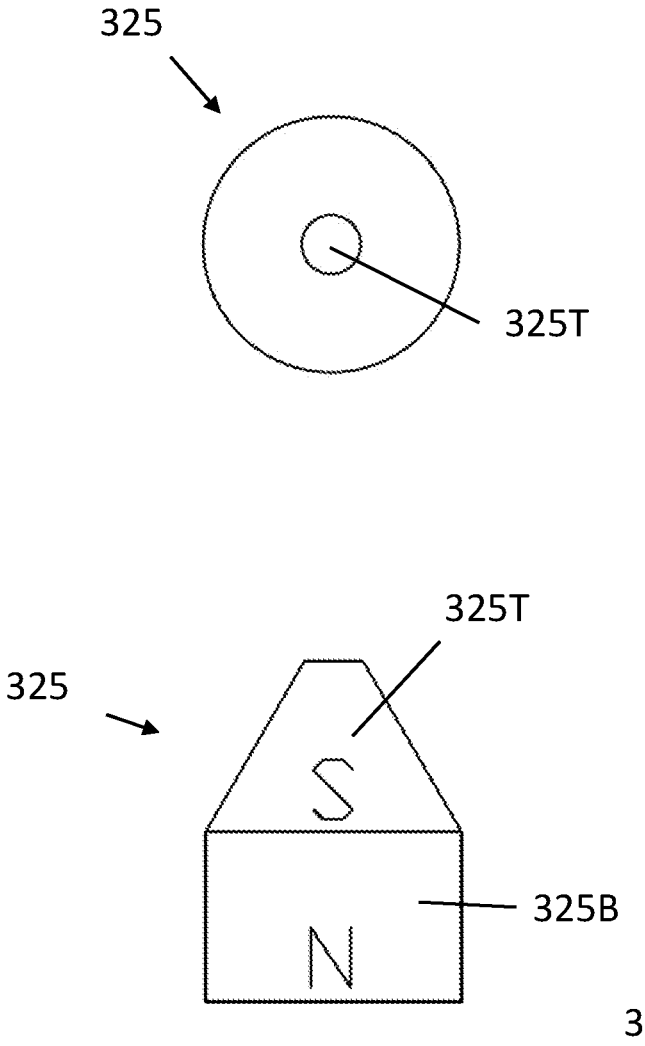
FIG. 7 depicts a side and top view of an exemplary magnet.
Figure 8:
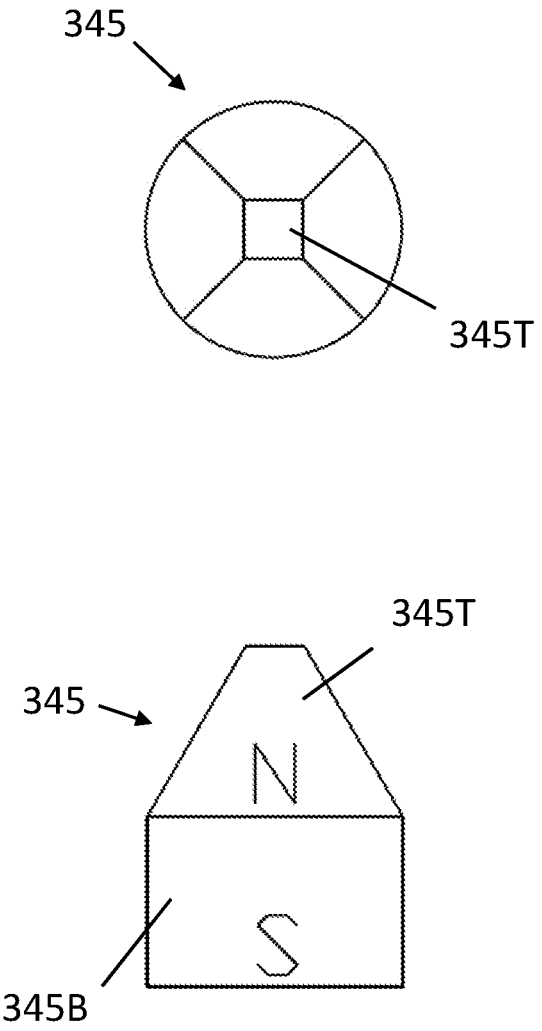
FIG. 8 depicts a side and top view of another exemplary magnet.

Additional aspects are now described with reference to FIGS. 7 and 8, which depict an exemplary magnet 325 and an exemplary corresponding magnet 345. As shown in FIGS. 7 and 8, the appearance and/or shape of any magnets described herein may vary. As shown in FIGS. 1-3, for example, each magnet 25A-C, 27A-C, 45A-C, and 47-AC may comprise a cylindrical shape extending along its respective depth axis Z-Z; each cylindrical shape may comprise a top face oriented toward top surface 31 or 51, and a bottom face oriented toward slide surface 33 or 53; and the top and bottom faces may be planar. The top and bottom poles of the magnets may be defined relative to their top and bottom faces. To help with manufacturing, a polarity indicator may be applied to one or both of the top and/or bottom faces to mitigate the risk of an erroneous installation, in which the polarities of one or more bottom poles are incorrectly arranged. For example, each magnet 25A-C, 27A-C, 45A-C, and 47-AC may comprise a polarity indicator comprising any visually distinguishable feature, such as a coloration or marking (e.g., an N or S symbol), allowing the manufacturer to visually verify the polarities magnets 25A-C, 27A-C, 45A-C, and 47-AC before performing additional manufacturing methods.

The polarity indicators also may comprise different shapes. An example is shown in FIG. 7, which depicts a first magnet 325 having a first three-dimensional shape; and FIG. 8, which depicts a second magnet 345 having a second three-dimensional shape. To provide further examples: in FIG. 1—magnets 25A-C and 27A-C may have a first polarity indicator, such as the shape of magnet 325 of FIG. 7, and magnets 45A-C and 47A-C may have a second polarity indicator, such as the shape of magnet 345 of FIG. 8; in FIGS. 3 and 4—representative magnets 25B, 125B may have the first indicator (e.g., like magnet 325) and representative magnets 45B, 145B may have the second indicator (like magnet 345); and in FIGS. 5 and 6—magnets 225A, 225C, and 245B may have the first polarity indicator (e.g., like magnet 325), and magnets 225B, 245A, and 245C may have the second polarity indicator (e.g., like magnet 345).

As shown in FIGS. 7 and 8, first magnet 325 may be polarized to define a top portion 325T opposite of a bottom portion 325B; and second magnet 345 may be polarized to define a top portion 345T opposite of a bottom portion 345B. The top poles of magnets 325, 345 may be defined by top portions 325T, 345T; and the bottom poles of magnets 325, 345 may be defined by bottom portions 325B, 345B. Each bottom portion 325B and 345B may have a similar three-dimensional shape. As shown in FIGS. 7 and 8, for example, each bottom portion 325B and 345B may have a cylindrical shape with a bottom face having a planar surface. As a further example, each cylindrical shape may have approximately the same diameter, allowing each magnet 325 and 345 to be dropped in a similarly sized hole formed in each central portion 32 and 52 of elongated body 21 or 41 during the manufacture of apparatus 20 and 40 using any known methods.

As also shown in FIGS. 7 and 8, each top portion 325T and 345T may have a three-dimensional shape that is different from one another and that of corresponding bottom portions 325B and 345B. For example, each top portion 325T and 345T may have a non-cylindrical shape that is different from the cylindrical shapes of bottom portions 325B and 325B; and the non-cylindrical shape of top portion 325T may be different from the non-cylindrical shape of top portion 345T. As shown in FIG. 7, the non-cylindrical shape of top portion 325T may comprise a circular top face and rounded edges, giving it a first appearance when viewed from the top; and, as shown in FIG. 8, the non-cylindrical shape of top portion 345T may comprise a square top face and angular edges, giving it a second appearance when viewed from the top. Portions 325T and 345T also may comprise any alphanumeric markings (e.g., N or S) and/or colorings. In some aspects, each top portion 325T and 345T may comprise a magnetic shielding element, such as an insulating coating, a metallic mesh or sheet, and/or a similar element; and aspects of the magnetic shielding elements may serve as polarity indicators.

As noted above, each sliding apparatus 20 and 40 may be generally for winter sports, such as one half of a split snowboard, a snowshoe, a sled, or the like; or generally for summer sports, such as a water ski, a wake board, a surf board, or the like. Additional aspects are now described with reference to FIG. 9, which depicts an exemplary system 410 comprising a sliding apparatus 420; and FIG. 10, which depicts an exemplary system 510 comprising a sliding apparatus 520. As before, aspects of sliding apparatus 420 and 520 may be similar to counterpart aspects of sliding apparatus 20, 40, 120, 140, 220, and/or 240, but within the respective 400 or 500 series of numbers, whether or not those aspects are expressly described or called out in FIGS. 9 and 10. Without limitation, any aspects described with reference to systems 410 and 510 may be applicable to any variation of systems 10, 110, and/or 210 described herein and vice versa, each possible iteration again being part of this disclosure.

Figure 9:
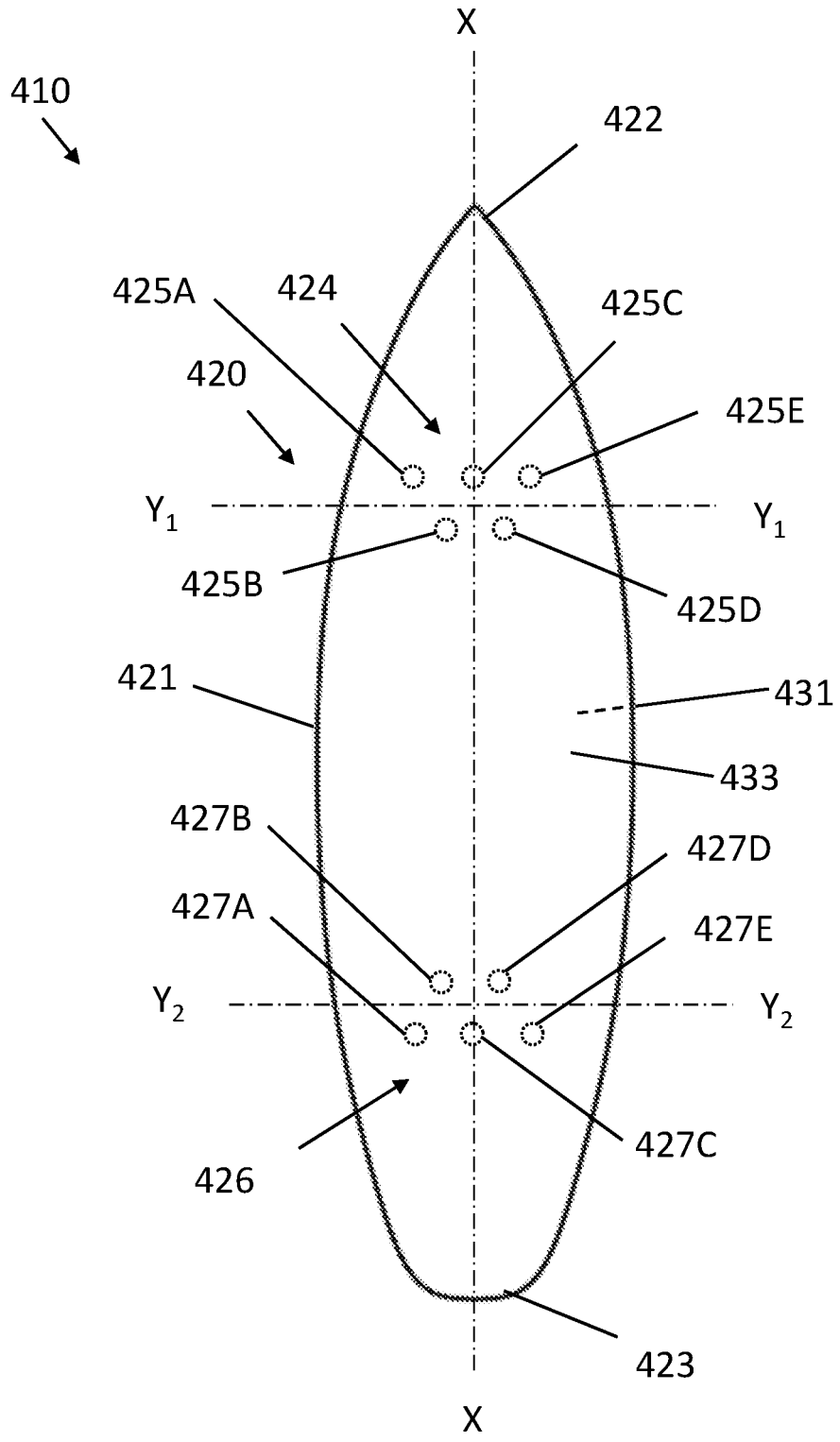
FIG. 9 depicts a bottom view of another exemplary sliding apparatus.

In system 410, sliding apparatus 420 may be any type of surfboard or equivalent apparatus configured to navigate flowing fluids and/or waves. As shown in FIG. 9, for example, sliding apparatus 420 may comprise: an elongated body 421 extending along a longitudinal axis X-X between a toe end 422 and a tail end 423; at least one coupler between toe end 422 and tail end 423, such as a toe coupler 424 proximate to toe end 422 and a tail coupler 426 proximate to tail end 423; a top surface 431; and a slide surface 433. Additional examples are now described.

The at least one coupler of sliding apparatus 420 may comprise any number of magnets in any arrangement described herein. For example, each of toe coupler 424 and tail coupler 426 may comprise magnets (e.g., at least three magnets) that are located in elongated body 421 between surfaces 431 and 433. Because surfboards are typically heavier and larger than skis, the number and/or arrangement of the magnets may be varied to accommodate the additional weight and/or size. As shown in FIG. 9, for example, toe coupler 424 may comprise a first array of magnets oriented about a first lateral axis $Y_1$-$Y_1$ intersecting longitudinal axis X-X, including a magnet 425C on axis X-X and magnets 425A, 425B and 425D, 425E on each side of axis X-X; and tail coupler 426 may comprise a second array of magnets oriented about a second lateral axis $Y_2$-$Y_2$ intersecting longitudinal axis X-X, including a magnet 427C on axis X-X and magnets 427A, 427B and 427D, 427E on each side of axis X-X. In some aspects, the comparatively wider dispersion of magnets 425A-E and 427A-E of FIG. 9 about their respective lateral axes $Y_1$-$Y_1$ and $Y_2$-$Y_2$ may result in stronger attraction forces between couplers 424, 426 and a corresponding set of couplers or structure.

Figure 10:
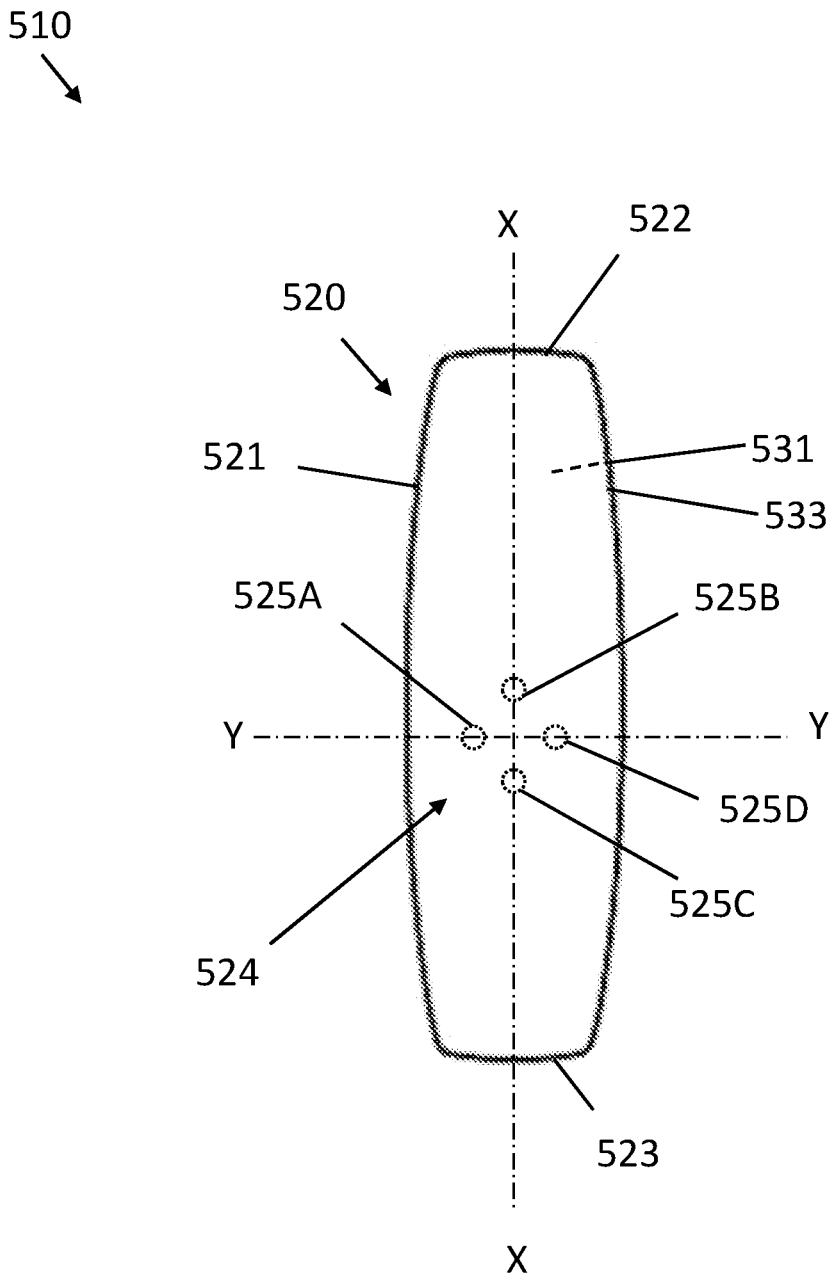
FIG. 10 depicts a bottom view of another exemplary sliding apparatus.

In system 510, sliding apparatus 520 may be any type of board or equivalent apparatus used generally for sliding down an incline, such as snow board; or being pulled behind a fluid navigation vehicle, such as a wake board pulled behind a boat or kite board pulled behind an aircraft. As shown in FIG. 10, for example, sliding apparatus 520 may comprise: an elongated body 521 extending along a longitudinal axis X-X between a toe end 522 and a tail end 523; at least one coupler 524 between toe end 522 and tail end 523; a top surface 531; and a slide surface 533. Each coupler 524 may comprise any number of magnets in any arrangement described herein; and each magnet may be located in elongated body 521 between surface 531 and 533. Because these types of boards are typically lighter and smaller than surfboards, the number and/or arrangement of the magnets may be varied to accommodate the reduced weight and/or size. As shown in FIG. 10, for example, each coupler 524 may comprise an array of magnets oriented relative to longitudinal axis X-X and a lateral axis Y-Y; and the array of magnets may include magnets 525B and 525C on longitudinal axis X-X and magnets 525A and 525D on each side of axis X-X. The centralized location of magnets 525A-D of FIG. 10 relative to axes X-X and Y-Y may provide sufficient attraction forces and reduce unwanted magnetic interactions with other elements attached to top surface 531, such as bindings. In some aspects, the array of magnets 525A-D may comprise a circular array having a diameter oriented relative to axes X-X and Y-Y.

If additional sliding apparatus 420 or 520 are to be used, then couplers 424, 426 and 524 may be magnetically attracted to corresponding coupler(s) on either side of each additional sliding apparatus 420 or 520 so that all of the apparatus may be transported together. For example, as before, each of magnets 425A-E, 427A-E, and 525A-D may be polarized to define top poles oriented toward top surfaces 431 or 531 and bottom poles oriented toward slide surface 433 or 533. As a further example, each apparatus 420 or 520 may be maintained in a stacked configuration with an additional apparatus 420 or 520 located above its top surface 431 or 531 and another apparatus 420 or 520 located below its slide surface 433 or 533 by the magnetic interactions between the respective couplers 424, 426, or 524 of each apparatus 420 or 520.

Accordingly, as described above, the plurality of magnets of any sliding apparatus 20, 40, 120, 140, 220, 240, 420, and 520 may comprise a pull force equal to at least a weight of their containing body 21, 41, 121, 141, 221, 241, 421, and 521.

Figure 11:
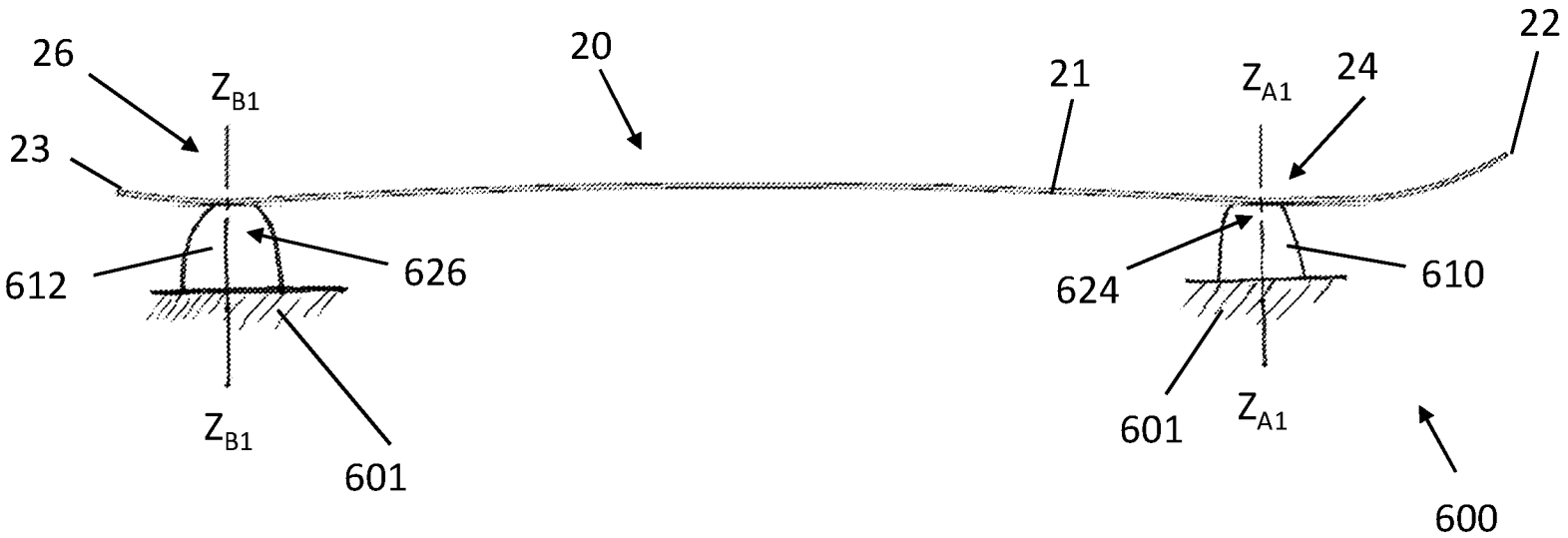
FIG. 11 depicts the first sliding apparatus of FIG. 1 and an exemplary mount.

The at least one coupler of any of sliding apparatus 20, 40, 120, 140, 220, 240, 420, and 520 also may be removably attached to one or more other objects. Exemplary objects are shown in FIG. 11, which depicts an exemplary mount 600; and in FIG. 12, which depicts an exemplary accessory 700. As described herein, any such objects, including mount 600 and accessory 700, may be removably attachable to any elongated body described herein by a magnetic interaction with one or more magnets of the plurality of magnets contained therein.

As shown in FIG. 11, for example, first sliding apparatus 20 of FIG. 1 may be removably attached to a set of mounts 600 comprising a first mount 610 and a second mount 612. As a further example, first mount 610 may comprise a first coupler 624 and second mount 612 may comprise a second coupler 626. First and second couplers 624 and 626 may comprise any number of magnets in any arrangement described herein. As shown in FIG. 11, for example, first and second couplers 624, 626 may be equivalent to toe and tail couplers 44, 46 of apparatus 40 of FIG. 1 (or couplers 244, 246 of apparatus 240 of FIG. 5) so that the resulting magnetic interactions with couplers 24, 26 of apparatus 20 (or 224, 226 of apparatus 220) are sufficient to maintain slide surface 33 (or 233) of apparatus 20 (or 220) against mounts 610 and 612 during transport.

Each mount 600 may integral to or engageable with another surface or structure. As shown in FIG. 11, for example, first and second mounts 610, 612 may comprise a mounting portion that is engageable with a common mounting surface 601, such as a car roof, a ceiling, a wall, or the like. If mounting surface 601 is metallic or contains additional magnets, then couplers 624 and 626 may be magnetically attractable thereto by any means described herein. In some aspects, the mounting portions of mounts 610 and 612 may be integral with another mounting structure, such as a support bar of a vehicle rack or a wakeboard tower; or portions of a wearable item, such as a backpack or a life jacket.

Absent some type of magnetic shielding, the magnetic fields of any magnets described herein may extend beyond the boundaries of their containing bodies. The relative strength of each magnetic field may depend upon the location of the magnets in their containing body. For example, if magnets 25A-C of FIG. 1 are centrally located in elongated body 21 and polarized along depth axis $Z_{A1}$-$Z_{A1}$, as shown in FIG. 3, then the strength of the magnetic fields at top surface 31 and at slide surface 33 may be approximately equal. As a further example, if the same magnets 25A-C are located closer to slide surface 33 along depth axis $Z_{A1}$-$Z_{A1}$, as shown in FIG. 4 with respect to magnet 125B, then the strength of the magnetic field at top surface 31 may be less than the strength of the magnetic field at slide surface 33. In either instance, the magnetic fields at surface 31 and/or 33 may be used to removably attach object(s) to sliding apparatus 20.

Figure 12:
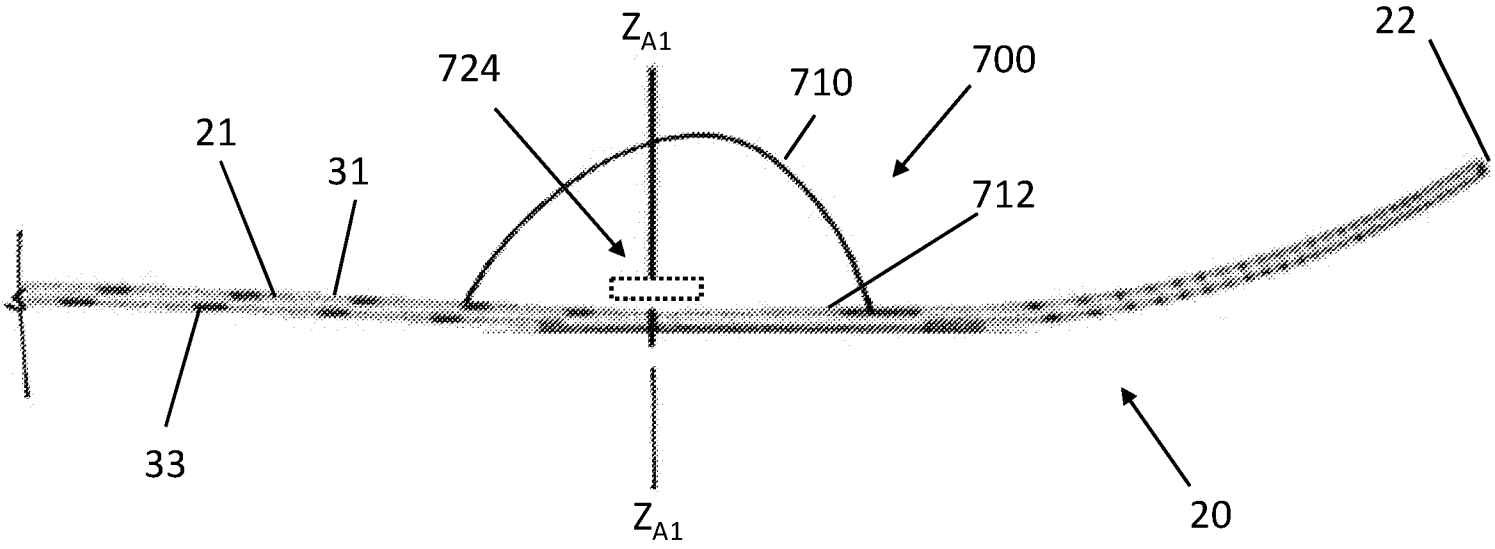
FIG. 12 depicts the first sliding apparatus of FIG. 1 and an exemplary accessory.

An example is shown in FIG. 12, which depicts an accessory 700 as being removably attached to top surface 31 of first sliding apparatus 20 of FIG. 1 by magnetic fields at top surface 31. A similar attachment may be made to slide surface 33. As a further example, accessory 700 may comprise a housing 710, an attachment surface 712, and an accessory coupler 724. Housing 710 may be made of any material, such as a rigid material (e.g., metal) or an impact absorbing material (e.g., foam); and attachment surface 712 may be contoured to fit and/or conformable against any shape of top surface 31 or slide surface 33. Accessory coupler 724 also may comprise any number of magnets in any arrangement described herein. For example, coupler 724 may be equivalent to toe coupler 44 of FIG. 1 (or coupler 244 of FIG. 5) so that the magnetic interactions between toe coupler 24 (or 244) and accessory coupler 724 are sufficient to maintain attachment surface 712 against top surface 31 (or 231) or slide surface 33 (or 233).

Housing 710 of FIG. 12 may assume any shape. For example, the shape of housing 710 may comprise a top portion that extends above or below a curvature of toe end 22 or tail end 23 of first sliding apparatus 20, such as a dome-shape extending outward from top surface 31 or a fin-shape extending outward from slide surface 33. As a further example, housing 710 also may comprise a handle configured to help remove housing 710, carry apparatus 20, and/or removably attach apparatus 20 to another object, such as a tow rope. Housing 710 also may be engageable with and/or configured to contain any number of electronic devices. For example, housing 710 also may comprise at least one of a camera, a light source, a memory, a processor, a sensor, and a tracking device; and/or the shape of housing 710 may be configured to aim such devices in any direction relative to apparatus 20, such as toward and/or over toe end 22, allowing data to be captured by and/or output from accessory 700 during use of sliding apparatus 20 without further modifications. As a further example, housing 710 also may comprise a storage bay, including an interior cavity sized to store a phone, keys, or the like.

Any system 10, 110, 210, 410, or 510 described above may comprise any number of mounts 600 or accessories 700 configured for use therewith. Magnets 325 and 345 also may be used in any of these systems. Any such combinations also may be packaged together in a kit with usage instructions and/or related accessories.

Numerous exemplary aspects have been described. In each of these aspects, magnets may be used to removably attach each sliding apparatus 20, 40, 120, 140, 220, 240, 420, or 520 to some other object, such as another sliding apparatus, mount 600, accessory 700, and/or any equivalent objects. Any number of magnets may be used. For example, the magnets may be (i) located between toe and tail ends of a body of each apparatus, (ii) spaced apart from one another in the body, (iii) polarized to define top poles oriented toward a top surface of the body and bottom poles oriented toward a slide surface of the body; and/or (iv) be arranged so the bottom poles have alternating polarities and/or are offset from the slide surface. However configured, the magnets of each sliding apparatus 20, 40, 120, 140, 220, 240, 420, or 520 may be magnetically attractable to corresponding magnets in and/or a magnetic portion of another object by a magnetic interaction that maintains an alignment and/or a position apparatus 20, 40, 120, 140, 220, 240, 420, or 520 relative to the other object.

While principles of the present disclosure are described herein with reference to illustrative aspects for particular applications, the disclosure is not limited thereto.

Those having ordinary skill in the art and access to the teachings provided herein will recognize additional modifications, applications, aspects, and substitution of equivalents all fall in the scope of the aspects described herein. Accordingly, the present disclosure is not to be considered as limited by the foregoing description.

Embodiments in which an exclusive property or privilege is claimed are defined as follows:

1. A sliding apparatus comprising:

an elongated body comprising a toe end, a tail end, a top surface, and a slide surface; and at least three magnets that are (i) located in the elongated body between the toe and tail ends, (ii) spaced apart from one another in a lateral direction extending across the elongated body, (iii) polarized to define top poles oriented toward the top surface and bottom poles oriented toward the slide surface, and (iv) arranged so the bottom poles have alternating polarities in the lateral direction.

2. The apparatus of claim 1, wherein each magnet of the at least three magnets comprises a rare earth metal.

3. The apparatus of claim 1, wherein:

the at least three magnets are located in the elongated body proximate to the toe end; and the apparatus comprises at least three additional magnets that are (i) located in the elongated body proximate to the tail end, (ii) spaced apart from one another in a second lateral direction extending across the elongated body, (iii) polarized to define top poles oriented toward the top surface and bottom poles oriented toward the slide surface, and (iv) arranged so the bottom poles have alternating polarities in the second lateral direction.

4. The apparatus of claim 3, wherein the alternating polarities of the at least three magnets are opposite of the alternating polarities of the at least three additional magnets.

5. The apparatus of claim 1, wherein a polarity indicator of each magnet of the at least three magnets for which the top pole has a first polarity is different from a polarity indicator of each magnet of the at least three magnets for which the top pole has a second polarity opposite the first polarity.

6. The apparatus of claim 3, wherein the lateral direction is parallel with the second lateral direction.

7. The apparatus of claim 1, wherein:

each magnet of the at least three magnets has a width; and the at least three magnets are spaced apart from another in the lateral direction by a distance that is equal to or less than the width.

8. The apparatus of claim 1, wherein a distance between the top surface of the elongated body and the at least three magnets is approximately equal to or greater than a distance between the slide surface of the elongated body and the at least three magnets.

9. The apparatus of claim 1, comprising:

a second sliding apparatus comprising:

an elongated body comprising a toe end, a tail end, a top surface, and a slide surface; and at least three magnets that are (i) located in the elongated body between the toe and tail ends, (ii) spaced apart from one another in a lateral direction extending across the elongated body, (iii) polarized to define top poles oriented toward the top surface and bottom poles oriented toward the slide surface, and (iv) arranged so the bottom poles have alternating polarities in the lateral direction, wherein the alternating polarities of the bottom poles of the at least three magnets of the first sliding apparatus are opposite of the alternating polarities of the bottom poles of the at least three magnets of the second sliding apparatus.

10. The apparatus of claim 9, wherein:

the at least three magnets of the sliding apparatus are located proximate to the toe end of the sliding apparatus;

the at least three magnets of the second sliding apparatus are located proximate to the toe end of the second sliding apparatus;

the sliding apparatus further comprises at least three additional magnets that are (i) located in the elongated body proximate to the tail end, (ii) spaced apart from one another in a second lateral direction extending across the elongated body, (iii) polarized to define top poles oriented toward the top surface and bottom poles oriented toward the slide surface, and (iv) arranged so the bottom poles have alternating polarities in the second lateral direction;

the second sliding apparatus further comprises at least three additional magnets that are (i) located in the elongated body proximate to the tail end, (ii) spaced apart from one another in a second lateral direction extending across the elongated body, (iii) polarized to define top poles oriented toward the top surface and bottom poles oriented toward the slide surface, and (iv) arranged so the bottom poles have alternating polarities in the second lateral direction; and the alternating polarities of the bottom poles of the at least three additional magnets of the sliding apparatus are opposite of the alternating polarities of the bottom poles of the at least three additional magnets of the second sliding apparatus.

11. The apparatus of claim 10, wherein:

the alternating polarities of the bottom poles of the at least three magnets located proximate to the toe end of the sliding apparatus are opposite the alternating polarities of the bottom poles of the at least three additional magnets located proximate to the tail end of the sliding apparatus; and the alternating polarities of the bottom poles of the at least three magnets located proximate to the toe end of the second sliding apparatus are opposite the alternating polarities of the bottom poles of the at least three additional magnets located proximate to the tail end of the second sliding apparatus.

12. A sliding apparatus comprising:

an elongated body comprising a toe end, a tail end, a top surface, and a slide surface; and a plurality of magnets that are (i) located in the elongated body between the toe and tail ends, (ii) spaced apart from one another in a lateral direction extending across the elongated body, (iii) offset from the slide surface, (iv) polarized to define top poles oriented toward the top surface and bottom poles oriented toward the slide surface, and (v) comprise a pull force equal to at least a weight of the elongated body.

13. The apparatus of claim 12, wherein the top surface of the elongated body is engageable with a binding and the pull force of the plurality of magnets is equal at least the weight of the elongated body and a weight of the binding.

14. The apparatus of claim 13, wherein the slide surface of the elongated body is engageable with a climbing skin and the pull force of the plurality of magnets is equal at least the weight of the elongated body, the weight of the binding, and a weight of the climbing skin.

15. The apparatus of claim 12, comprising:

a second sliding apparatus comprising:

an elongated body comprising a toe end, a tail end, a top surface, and a slide surface; and a plurality of magnets that are (i) located in the elongated body between the toe and tail ends, (ii) spaced apart from one another in a lateral direction extending across the elongated body, (iii) offset from the slide surface, (iv) polarized to define top poles oriented toward the top surface and bottom poles oriented toward the slide surface, and (v) comprise a pull force equal to at least a weight of the elongated body.

16. The apparatus of claim 12, comprising an object that is removably attachable to the elongated body by a magnetic interaction with one or more magnets of the plurality of magnets and comprises one of: a camera; a light source; a memory; a mounting portion; a power source; a processor; a sensor; and a storage bay.

17. A sliding apparatus comprising:

an elongated body comprising a toe end, a tail end, a top surface, a slide surface, and a reinforcing material adjacent the slide surface; and at least one set of magnets that are (i) located in the elongated body between the toe and tail ends, (ii) spaced apart from one another in a lateral direction extending across the elongated body, (iii) offset from the slide surface, (iv) adjacent the reinforcing material, and (v) polarized to define top poles oriented toward the top surface and bottom poles oriented toward the slide surface.

18. The apparatus of claim 17, wherein the slide surface comprises a polymeric material and the reinforcing material is attached to the polymeric material.

19. The apparatus of claim 17, comprising a magnetic shielding layer located between the top surface of the elongated body and the at least one set of magnets.

20. The apparatus of claim 17, wherein the lateral direction is curved relative to the elongated body.

* * * * *